US010837652B2

(12) United States Patent
Balekundri et al.

(10) Patent No.: US 10,837,652 B2
(45) Date of Patent: Nov. 17, 2020

(54) APPLIANCE SECONDARY DOOR

(71) Applicant: WHIRLPOOL CORPORATION, Benton Harbor, MI (US)

(72) Inventors: Abubackar M. Balekundri, Belgaum (IN); Ajit J. Manohar, Nagpur (IN); Arun Patil, Sangli (IN)

(73) Assignee: Whirlpool Corporation, Benton Harbor, MI (US)

( * ) Notice: Subject to any disclaimer, the term of this patent is extended or adjusted under 35 U.S.C. 154(b) by 115 days.

(21) Appl. No.: 16/038,533

(22) Filed: Jul. 18, 2018

(65) Prior Publication Data

US 2020/0025392 A1 Jan. 23, 2020

(51) Int. Cl.
*F24C 15/16* (2006.01)
*F24C 15/02* (2006.01)

(52) U.S. Cl.
CPC ..... *F24C 15/162* (2013.01); *F24C 15/023* (2013.01); *F24C 15/028* (2013.01)

(58) Field of Classification Search
CPC .... F24C 15/162; F24C 15/028; F24C 15/023; F24C 11/00; A47L 15/0084; A47L 15/4257; A47L 15/4261; A47L 15/4263
USPC ..... 312/291, 292, 309–311
See application file for complete search history.

(56) References Cited

U.S. PATENT DOCUMENTS 1,141,176 A 6/1915 Copeman
1,380,656 A 6/1921 Lauth
1,405,624 A 2/1922 Patterson
1,598,996 A 9/1926 Wheelock
1,808,550 A 6/1931 Harpman
(Continued)

FOREIGN PATENT DOCUMENTS

CA 2365023 A1 7/2002
CA 2734926 A1 10/2011
(Continued)

OTHER PUBLICATIONS

Built-In Gas Cooktop, image post date Feb. 18, 2015, originally in U.S. Appl. No. 29/539,768 in Restriction Requirement dated Oct. 27, 2016, 10 pages, <http://www.bestbuy.com/site/kitchenaid-36-built-in-gas-cooktop-stainless-steel/8636634.p?skuId=8636634>.
(Continued)

*Primary Examiner* — Grant Moubry
*Assistant Examiner* — Rabeeul I Zuberi
(74) *Attorney, Agent, or Firm* — Price Heneveld LLP

(57) ABSTRACT

An appliance door assembly is provided that comprises a primary door pivotally coupled to an appliance and positioned to seal a cavity defined by the appliance and a secondary door slideably coupled to the primary door. The secondary door is slidable between a first position and a second position when the primary door is in a closed position. The appliance door assembly further includes first and second engagement features operable between first and second positions. The secondary door is operably coupled to a track assembly disposed within the cavity when the first engagement feature is in the first position. The first and second positions of the second engagement feature correspond with the first and second positions of the first engagement feature. The secondary door is operably coupled to a rack disposed within the cavity when the second engagement feature is in the first position.

13 Claims, 13 Drawing Sheets

(56) References Cited

U.S. PATENT DOCUMENTS 2,024,510 A 12/1935 Crisenberry
2,530,991 A 11/1950 Reeves
2,536,613 A 1/1951 Schulze et al.
2,699,912 A 1/1955 Cushman
2,777,407 A 1/1957 Schindler
2,781,038 A 2/1957 Sherman
2,791,366 A 5/1957 Geisler
2,815,018 A 12/1957 Collins
2,828,608 A 4/1958 Cowlin et al.
2,847,932 A 8/1958 More
2,930,194 A 5/1960 Perkins
2,934,957 A 5/1960 Reinhart et al.
D191,085 S 8/1961 Kindl et al.
3,017,924 A 1/1962 Jenson
3,051,813 A 8/1962 Busch et al.
3,065,342 A 11/1962 Worden
3,089,407 A 5/1963 Kinkle
3,259,120 A 7/1966 Keating
3,386,431 A 6/1968 Branson
3,463,138 A 8/1969 Lotter et al.
3,489,135 A 1/1970 Astrella
3,548,154 A 12/1970 Christiansson
3,602,131 A 8/1971 Dadson
3,645,249 A 2/1972 Henderson et al.
3,691,937 A 9/1972 Meek et al.
3,731,035 A 5/1973 Jarvis et al.
3,777,985 A 12/1973 Hughes et al.
3,780,954 A 12/1973 Genbauffs
3,857,254 A 12/1974 Lobel
3,877,865 A 4/1975 Duperow
3,899,655 A 8/1975 Skinner
D245,663 S 9/1977 Gordon
4,104,952 A 8/1978 Brass
4,149,518 A 4/1979 Schmidt et al.
4,363,956 A 12/1982 Scheidler et al.
4,413,610 A 11/1983 Berlik
4,418,456 A 12/1983 Riehl
4,447,711 A 5/1984 Fischer
4,466,789 A 8/1984 Riehl
4,518,346 A 5/1985 Pistien
4,587,946 A 5/1986 Doyon et al.
4,646,963 A 3/1987 Delotto et al.
4,654,508 A 3/1987 Logel et al.
4,689,961 A 9/1987 Stratton
4,812,624 A 3/1989 Kern
4,818,824 A 4/1989 Dixit et al.
4,846,671 A 7/1989 Kwiatek
4,886,043 A 12/1989 Homer
4,891,936 A 1/1990 Shekleton et al.
D309,398 S 7/1990 Lund
4,981,416 A 1/1991 Nevin et al.
4,989,404 A 2/1991 Shekleton
5,021,762 A 6/1991 Hetrick
5,136,277 A 8/1992 Civanelli et al.
5,171,951 A 12/1992 Chartrain et al.
D332,385 S 1/1993 Adams
5,215,074 A 6/1993 Wilson et al.
5,243,172 A 9/1993 Hazan et al.
D340,383 S 10/1993 Addison et al.
5,272,317 A 12/1993 Ryu
D342,865 S 1/1994 Addison et al.
5,316,423 A 5/1994 Kin
5,397,234 A 3/1995 Kwiatek
5,448,036 A 9/1995 Husslein et al.
D364,993 S 12/1995 Andrea
5,491,423 A 2/1996 Turetta
D369,517 S 5/1996 Ferlin
5,546,927 A 8/1996 Lancelot
5,571,434 A 11/1996 Cavener et al.
D378,578 S 3/1997 Eberhardt
5,618,458 A 4/1997 Thomas
5,649,822 A 7/1997 Gertler et al.
5,735,261 A 4/1998 Kieslinger
5,785,047 A 7/1998 Bird et al.
5,842,849 A 12/1998 Huang
5,913,675 A 6/1999 Vago et al.
5,928,540 A 7/1999 Antoine et al.
D414,377 S 9/1999 Huang
5,967,021 A 10/1999 Yung
6,016,096 A 1/2000 Barnes et al.
6,030,207 A 2/2000 Saleri
6,049,267 A 4/2000 Barnes et al.
6,050,176 A 4/2000 Schultheis et al.
6,078,243 A 6/2000 Barnes et al.
6,089,219 A 7/2000 Kodera et al.
6,092,518 A 7/2000 Dane
6,111,229 A 8/2000 Schultheis
6,114,665 A 9/2000 Garcia et al.
6,133,816 A 10/2000 Barnes et al.
6,155,820 A 12/2000 Döbbeling
6,188,045 B1 2/2001 Hansen et al.
6,192,669 B1 2/2001 Keller et al.
6,196,113 B1 3/2001 Yung
6,253,759 B1 7/2001 Giebel et al.
6,253,761 B1 7/2001 Shuler et al.
6,320,169 B1 11/2001 Clothier
6,322,354 B1 11/2001 Carbone et al.
6,362,458 B1 3/2002 Sargunam et al.
6,452,136 B1 9/2002 Berkcan et al.
6,452,141 B1 9/2002 Shon
6,589,046 B2 7/2003 Harneit
6,614,006 B2 9/2003 Pastore et al.
6,619,280 B1 9/2003 Zhou et al.
6,655,954 B2 12/2003 Dane
6,663,009 B1 12/2003 Bedetti et al.
6,718,965 B2 4/2004 Rummel et al.
6,733,146 B1 5/2004 Vastano
6,806,444 B2 10/2004 Lemer
6,811,236 B1 * 11/2004 Spong ..... E05C 19/166
312/222
6,837,151 B2 1/2005 Chen
6,891,133 B2 5/2005 Shozo et al.
6,910,342 B2 6/2005 Berns et al.
6,930,287 B2 8/2005 Gerola et al.
6,953,915 B2 10/2005 Garris, III
7,005,614 B2 2/2006 Lee
7,017,572 B2 3/2006 Cadima
D524,105 S 7/2006 Poltronieri
7,083,123 B2 8/2006 Molla
7,220,945 B1 5/2007 Wang
D544,753 S 6/2007 Tseng
7,274,008 B2 9/2007 Arnal Valero et al.
7,281,715 B2 10/2007 Boswell
7,291,009 B2 11/2007 Kamal et al.
7,315,247 B2 1/2008 Jung et al.
7,325,480 B2 2/2008 Grühbaum et al.
D564,296 S 3/2008 Koch et al.
7,348,520 B2 3/2008 Wang
7,368,685 B2 5/2008 Nam et al.
7,411,160 B2 8/2008 Duncan et al.
7,414,203 B2 8/2008 Winkler
7,417,204 B2 8/2008 Nam et al.
D581,736 S 12/2008 Besseas
7,468,496 B2 12/2008 Marchand
D592,445 S 5/2009 Sorenson et al.
7,527,495 B2 5/2009 Yam et al.
D598,959 S 8/2009 Kiddoo
7,589,299 B2 9/2009 Fisher et al.
D604,098 S 11/2009 Hamlin
7,614,877 B2 11/2009 McCrorey et al.
7,628,609 B2 12/2009 Pryor et al.
7,640,930 B2 1/2010 Little et al.
7,696,454 B2 4/2010 Nam et al.
7,708,008 B2 5/2010 Elkasevic et al.
7,721,727 B2 5/2010 Kobayashi
7,731,493 B2 6/2010 Starnini et al.
7,762,250 B2 7/2010 Elkasevic et al.
7,770,985 B2 8/2010 Davis et al.
7,781,702 B2 8/2010 Nam et al.
7,823,502 B2 11/2010 Hecker et al.
7,829,825 B2 11/2010 Kühne
7,840,740 B2 11/2010 Minoo
7,841,333 B2 11/2010 Kobayashi
7,964,823 B2 6/2011 Armstrong et al.

(56) References Cited

U.S. PATENT DOCUMENTS

D642,675 S 8/2011 Scribano et al.
8,006,687 B2 8/2011 Watkins et al.
8,015,821 B2 9/2011 Spytek
8,037,689 B2 10/2011 Oskin et al.
8,057,223 B2 11/2011 Pryor et al.
8,141,549 B2 3/2012 Armstrong et al.
8,217,314 B2 7/2012 Kim et al.
8,220,450 B2 7/2012 Luo et al.
8,222,578 B2 7/2012 Beier
D665,491 S 8/2012 Goel et al.
8,272,321 B1 9/2012 Kalsi et al.
8,288,690 B2 10/2012 Boubeddi et al.
8,302,593 B2 11/2012 Cadima
8,304,695 B2 11/2012 Bonuso et al.
8,342,165 B2 1/2013 Watkins
8,344,292 B2 1/2013 Franca et al.
8,393,317 B2 3/2013 Sorenson et al.
8,398,303 B2 3/2013 Kuhn
8,430,310 B1 4/2013 Ho et al.
8,464,703 B2 6/2013 Ryu et al.
D685,225 S 7/2013 Santoyo et al.
D687,675 S 8/2013 Filho et al.
8,526,935 B2 9/2013 Besore et al.
8,535,052 B2 9/2013 Cadima
D693,175 S 11/2013 Saubert
8,584,663 B2 11/2013 Kim et al.
8,596,259 B2 12/2013 Padgett et al.
8,616,193 B2 12/2013 Padgett
8,660,297 B2 2/2014 Yoon et al.
8,687,842 B2 4/2014 Yoon et al.
8,689,782 B2 4/2014 Padgett
8,707,945 B2 4/2014 Hasslberger et al.
8,747,108 B2 6/2014 Lona Santoyo et al.
8,800,543 B2 8/2014 Simms et al.
D718,061 S 11/2014 Wu
8,887,710 B2 11/2014 Rossi et al.
8,930,160 B2 1/2015 Wall et al.
8,932,049 B2 1/2015 Ryu et al.
8,950,389 B2 2/2015 Horstkoetter et al.
8,978,637 B2 3/2015 Ryu et al.
D727,489 S 4/2015 Rohskopf et al.
9,021,942 B2 5/2015 Lee et al.
9,074,765 B2 7/2015 Armanni
D735,525 S 8/2015 Nguyen
9,113,503 B2 8/2015 Amal Valero et al.
9,132,302 B2 9/2015 Luongo et al.
D743,203 S 11/2015 Filho et al.
9,175,858 B2 11/2015 Tisselli et al.
D750,314 S 2/2016 Hobson et al.
9,307,888 B2 4/2016 Baldwin et al.
D758,107 S 6/2016 Hamilton
D766,036 S 9/2016 Koch et al.
D766,696 S 9/2016 Kemker
9,513,015 B2 12/2016 Estrella et al.
9,521,708 B2 12/2016 Adelmann et al.
9,557,063 B2 1/2017 Cadima
9,572,475 B2 2/2017 Gephart et al.
9,644,847 B2 5/2017 Bhogal et al.
9,696,042 B2 7/2017 Hasslberger et al.
9,879,864 B2 1/2018 Gutierrez et al.
9,927,129 B2 3/2018 Bhogal et al.
2002/0065039 A1 5/2002 Benezech et al.
2004/0007566 A1 1/2004 Staebler et al.
2004/0031782 A1 2/2004 Westfield
2004/0195399 A1 10/2004 Molla
2004/0224273 A1 11/2004 Inomata
2004/0224274 A1 11/2004 Tomiura
2005/0029245 A1 2/2005 Gerola et al.
2005/0112520 A1 5/2005 Todoli et al.
2005/0199232 A1 9/2005 Gama et al.
2005/0268000 A1 12/2005 Carlson
2005/0268794 A1 12/2005 Nesterov
2007/0124972 A1 6/2007 Ratcliffe
2007/0181410 A1 8/2007 Baier
2007/0251936 A1 11/2007 Nam et al.
2007/0281267 A1 12/2007 Li
2008/0029081 A1 2/2008 Gagas
2008/0050687 A1 2/2008 Wu
2008/0173632 A1 7/2008 Jang et al.
2008/0210685 A1 9/2008 Beier
2009/0173730 A1 7/2009 Baier et al.
2009/0320823 A1 12/2009 Padgett
2010/0035197 A1 2/2010 Cadima
2010/0114339 A1 5/2010 Kaiser et al.
2010/0126496 A1 5/2010 Luo et al.
2010/0192939 A1 8/2010 Parks
2011/0142998 A1 6/2011 Johncock et al.
2011/0163086 A1 7/2011 Aldana Arjol et al.
2011/0248021 A1 10/2011 Gutierrez et al.
2012/0017595 A1 1/2012 Liu
2012/0024835 A1 2/2012 Artal Lahoz et al.
2012/0036855 A1 2/2012 Hull
2012/0067334 A1 3/2012 Kim et al.
2012/0076351 A1 3/2012 Yoon et al.
2012/0099761 A1 4/2012 Yoon et al.
2012/0160228 A1 6/2012 Kim et al.
2012/0171343 A1 7/2012 Cadima et al.
2012/0261405 A1 10/2012 Kurose et al.
2013/0043239 A1 2/2013 Anton Falcon et al.
2013/0252188 A1 9/2013 Chen
2013/0255663 A1 10/2013 Cadima et al.
2013/0260618 A1 10/2013 Bally et al.
2014/0048055 A1 2/2014 Ruther
2014/0071019 A1 3/2014 Lim
2014/0090636 A1 4/2014 Bettinzoli
2014/0097172 A1 4/2014 Kang et al.
2014/0116416 A1 5/2014 Saubert
2014/0137751 A1 5/2014 Bellm
2014/0139381 A1 5/2014 Sippel
2014/0318527 A1 10/2014 Silva et al.
2014/0319990 A1* 10/2014 Gephart ..... A47L 15/0084 312/405
2014/0352549 A1 12/2014 Upston et al.
2015/0096974 A1 4/2015 Freeman et al.
2015/0136760 A1 5/2015 Lima et al.
2015/0153041 A1 6/2015 Neumeier
2015/0241069 A1 8/2015 Brant et al.
2015/0330640 A1 11/2015 Wersborg
2015/0345800 A1 12/2015 Cabrera Botello
2015/0359045 A1 12/2015 Neukamm et al.
2015/0377493 A1* 12/2015 Kim ..... F24C 15/028 126/339
2016/0029439 A1 1/2016 Kurose et al.
2016/0061490 A1 3/2016 Cho et al.
2016/0091210 A1 3/2016 Ceccoli
2016/0095469 A1 4/2016 Gregory et al.
2016/0116160 A1 4/2016 Takeuchi
2016/0153666 A1 6/2016 Tcaciuc
2016/0174768 A1 6/2016 Deverse
2016/0178209 A1 6/2016 Park et al.
2016/0178212 A1 6/2016 Park et al.
2016/0187002 A1 6/2016 Ryu et al.
2016/0201902 A1 7/2016 Cadima
2016/0209044 A1 7/2016 Cadima
2016/0209045 A1 7/2016 Millius
2016/0295644 A1 10/2016 Khokle et al.
2016/0296067 A1 10/2016 Laws
2017/0003033 A1 1/2017 Lona Santoyo et al.
2017/0067651 A1 3/2017 Khokle et al.
2017/0074522 A1 3/2017 Cheng
2017/0082296 A1 3/2017 Jeong et al.
2017/0082299 A1 3/2017 Rowley et al.
2017/0108228 A1 4/2017 Park et al.
2017/0115008 A1 4/2017 Erbe et al.
2017/0261213 A1 4/2017 Park et al.
2017/0223774 A1 8/2017 Cheng et al.
2018/0058702 A1 3/2018 Jang et al.
2018/0073743 A1* 3/2018 Adelmann ..... F24C 11/00

FOREIGN PATENT DOCUMENTS

CN 201680430 U 12/2010
DE 2845869 A1 4/1980
DE 3014908 A1 10/1981

(56) References Cited

FOREIGN PATENT DOCUMENTS

| | | | |
|---|---|---|---|
| DE | 3238441 | A1 | 4/1984 |
| DE | 3446621 | A1 | 6/1986 |
| DE | 3717728 | A1 | 12/1988 |
| DE | 3150450 | C2 | 8/1989 |
| DE | 3839657 | A1 | 5/1990 |
| DE | 4103664 | C1 | 1/1992 |
| DE | 4445594 | A1 | 6/1996 |
| DE | 10218294 | A1 | 11/2003 |
| DE | 60004581 | T2 | 6/2004 |
| DE | 102004002466 | A1 | 8/2005 |
| DE | 19912452 | B4 | 10/2007 |
| DE | 102006034391 | A1 | 1/2008 |
| DE | 102007021297 | A1 | 11/2008 |
| DE | 102008027220 | A1 | 12/2009 |
| DE | 102008042467 | A1 | 4/2010 |
| DE | 102009002276 | A1 | 10/2010 |
| DE | 102013218714 | A1 | 4/2014 |
| EP | 0122966 | A2 | 10/1984 |
| EP | 0429120 | A2 | 5/1991 |
| EP | 0620698 | A1 | 10/1994 |
| EP | 0690659 | A2 | 1/1996 |
| EP | 1030114 | A1 | 8/2000 |
| EP | 1217306 | A2 | 6/2002 |
| EP | 1344986 | A1 | 9/2003 |
| EP | 1586822 | A1 | 10/2005 |
| EP | 1099905 | B1 | 2/2006 |
| EP | 1201998 | B1 | 3/2006 |
| EP | 1460342 | B1 | 5/2006 |
| EP | 2063181 | A2 | 5/2009 |
| EP | 2063444 | A1 | 5/2009 |
| EP | 2116775 | A1 | 11/2009 |
| EP | 2116829 | A1 | 11/2009 |
| EP | 2278227 | A2 | 1/2011 |
| EP | 2299181 | A1 | 3/2011 |
| EP | 2375170 | A1 | 10/2011 |
| EP | 2144012 | B1 | 9/2012 |
| EP | 2657615 | A1 | 10/2013 |
| EP | 2816291 | A1 | 12/2014 |
| EP | 2835580 | A2 | 2/2015 |
| EP | 3006832 | A1 | 4/2016 |
| EP | 2848867 | B1 | 9/2017 |
| FR | 2787556 | A1 | 6/2000 |
| FR | 2789753 | A1 | 8/2000 |
| FR | 3003338 | A1 | 9/2014 |
| GB | 2158225 | A | 11/1985 |
| JP | 2001141244 | A | 5/2001 |
| JP | 2005009693 | A | 1/2005 |
| JP | 2007147131 | A | 6/2007 |
| JP | 2010038475 | A | 2/2010 |
| JP | 2011257021 | A | 12/2011 |
| WO | 9113526 | A1 | 9/1991 |
| WO | 9850736 | A1 | 11/1998 |
| WO | 2006072388 | A1 | 7/2006 |
| WO | 2006136363 | A1 | 12/2006 |
| WO | 2012077050 | A2 | 6/2012 |
| WO | 2013098330 | A2 | 7/2013 |
| WO | 2013182410 | A1 | 12/2013 |
| WO | 2014194176 | A1 | 12/2014 |
| WO | 2015086420 | A1 | 6/2015 |

OTHER PUBLICATIONS

True-Heat burner, image post date Jan. 30, 2015, originally in U.S. Appl. No. 29/539,768 in Restriction Requirement dated Oct. 27, 2016, 2 pages, <http://ovens.reviewed.com/news/kitchenaid-has-a-new-fame>.

Metal Cover Gas Hob, image post date 2012, originally in U.S. Appl. No. 29/539,768 in Restriction Requirement dated Oct. 27, 2016, 13 pages, <http://inse.gmc.globalmarket.com/products/details/metal-cover-gas-hob-8516959.html>.

Penny Stove, image post date 2004, originally in U.S. Appl. No. 29/539,768 in Restriction Requirement dated Oct. 27, 2016, 30 pages, <http://www.jureystudio.com/pennystove/stoveinstruction.html>.

* cited by examiner

APPLIANCE SECONDARY DOOR

FIELD OF DISCLOSURE

The present device generally relates to a secondary door for an appliance, and more specifically, to a secondary door positioned in a primary door of an appliance.

BACKGROUND

Currently, appliances may include single or double doors providing access to one or more interior cavities. Particularly with ovens, this current configuration requires a user to open the door(s) fully, causing heat loss and increasing the risk of burns as the user accesses the cavity. Accordingly, an appliance is provided herein having a secondary door positioned within a primary door(s) to allow access to a rack of the cavity without requiring the user to open the primary door.

SUMMARY

In at least one aspect, an appliance door assembly is provided that comprises a primary door pivotally coupled to an appliance and positioned to seal a cavity defined by the appliance and a secondary door slideably coupled to the primary door. The secondary door is slidable between a first position and a second position when the primary door is in a closed position. The appliance door assembly further comprises a first engagement feature operable between first and second positions. The secondary door is operably coupled to a track assembly disposed within the cavity when the first engagement feature is in the first position. The appliance door assembly also comprises a second engagement feature operable between first and second positions. The first and second positions of the second engagement feature correspond with the first and second positions of the first engagement feature. The secondary door is operably coupled to a rack disposed within the cavity when the second engagement feature is in the first position.

In at least another aspect, an appliance door assembly is provided that comprises a primary door having a primary door frame pivotally coupled to an appliance. The appliance defines a cavity. A secondary door is positioned within the primary door and is selectively couplable to the primary door frame. An actuator is positioned on the appliance, and an engagement feature is selectively engageable with a rack disposed within the cavity.

In at least another aspect, an appliance door assembly is provided that comprises a primary door having a primary door frame. The primary door and the primary door frame are pivotally coupled to an appliance. A secondary door is positioned between a first end and a second end of the primary door and is selectively couplable to the primary door frame. An actuator is positioned on the appliance and is operably coupled to a first engagement feature. The first engagement feature is selectively engageable with a track assembly. A second engagement feature is operably coupled to the actuator. The second engagement feature is selectively engageable with a rack.

These and other features, advantages, and objects of the present device will be further understood and appreciated by those skilled in the art upon studying the following specification, claims, and appended drawings.

DETAILED DESCRIPTION OF THE EMBODIMENTS

Figure 1A:
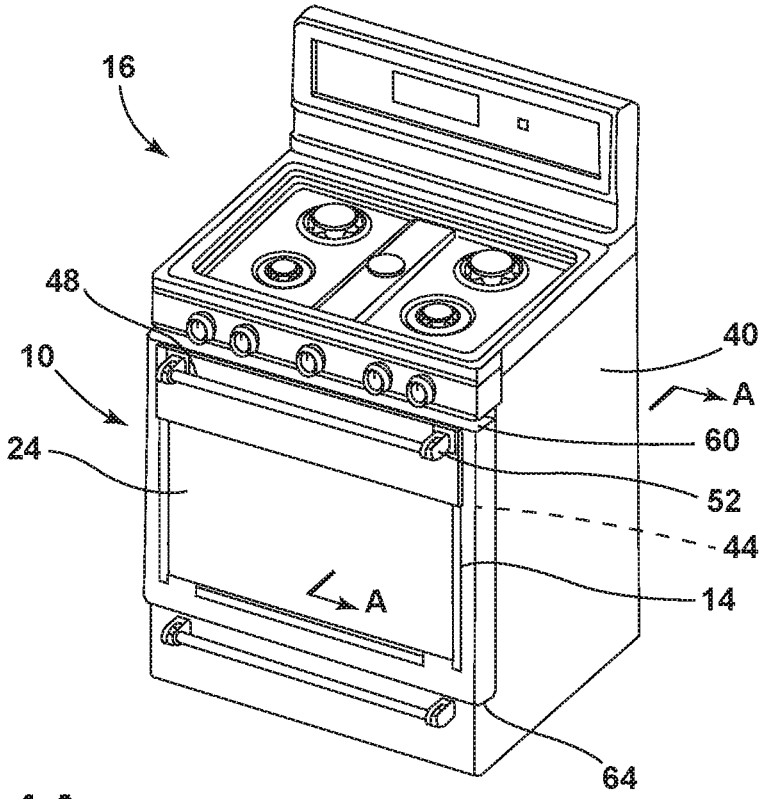
FIG. 1A is a side perspective view of an appliance according to some examples.

For purposes of description herein the terms "upper," "lower," "right," "left," "rear," "front," "vertical," "horizontal," and derivatives thereof shall relate to the device as oriented in FIG. 1A. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1A-12, the reference numeral 10 generally denotes an appliance door assembly comprising a primary door 14 pivotally coupled to an appliance 16 and positioned to seal a cavity 20 defined by the appliance 16. A secondary door 24 is slidably coupled to the primary door 14, and the secondary door 24 is slideable between a first position and a second position when the primary door 14 is in a closed position. The appliance door assembly 10 further comprises a first engagement feature 28 operable between first and second positions, wherein the secondary door 24 is operably coupled to a rack 26 disposed within the cavity 20 when the first engagement feature 28 is in the first position. The appliance door assembly 10 further comprises a second engagement feature operable between first and second positions, wherein the first and second positions of the second engagement feature correspond with the first and second positions of the first engagement feature 28. The secondary door 24 is operably coupled to a track assembly 30 disposed within the cavity 20 when the second engagement feature is in the second position.

Figure 1B:
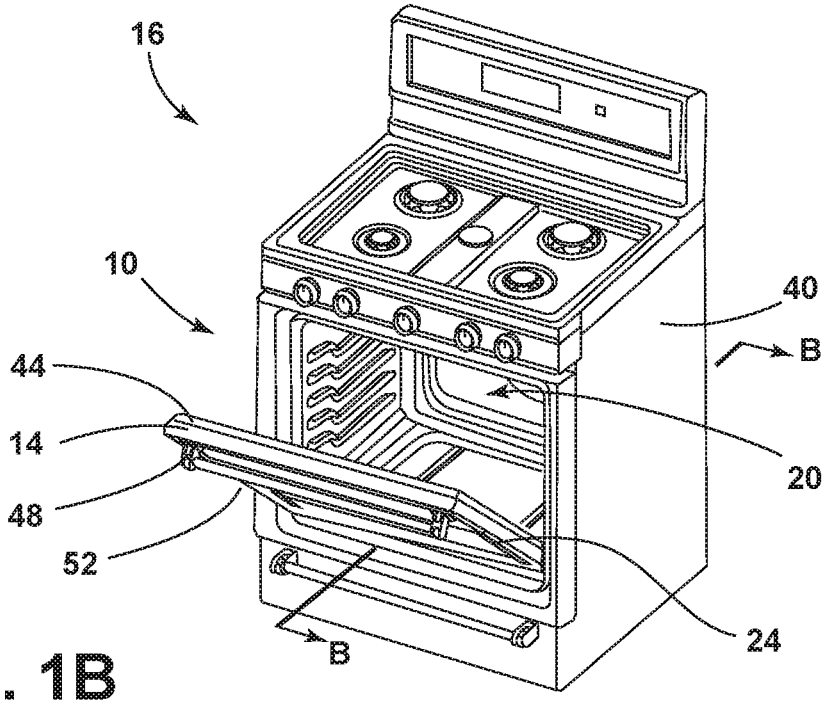
FIG. 1B is a side perspective view of the appliance of FIG. 1A with a primary door in an open position.
Figure 1C:
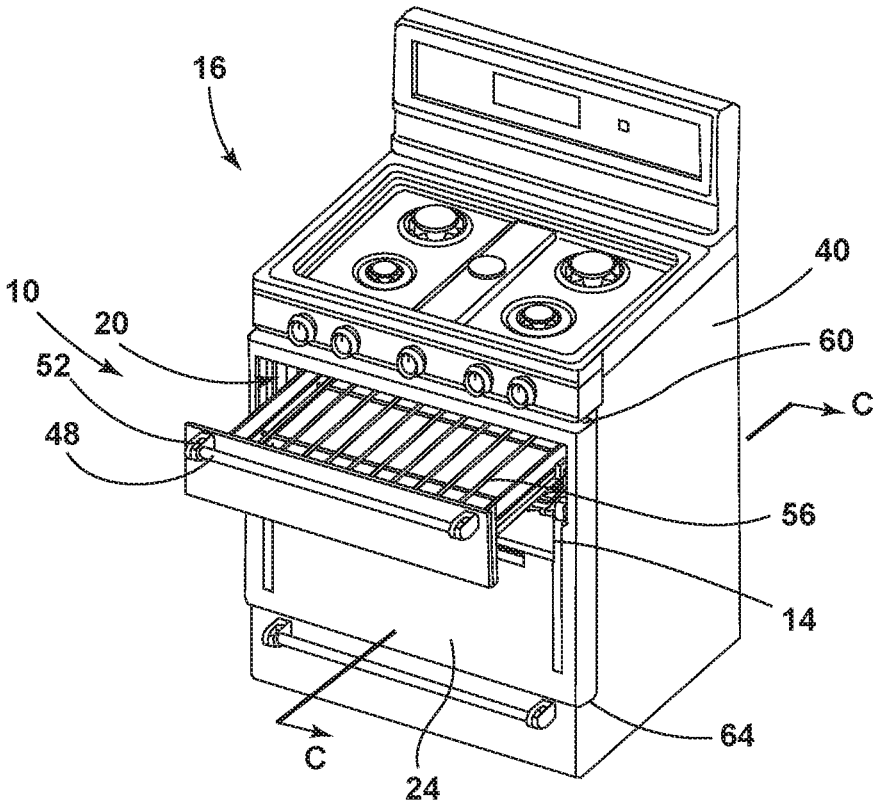
FIG. 1C is a side perspective view of the appliance of FIG. 1A with a secondary door in an open position while the primary door is in a closed position.

Referring now to FIGS. 1A-1C, the appliance 16 includes an appliance body 40 that defines the cavity 20. The appliance body 40 is selectively closeable by the primary door 14, and the primary door 14 may be operably coupled to a primary door frame 44. The primary door 14 is pivotally coupled to the appliance body 40 and includes a primary handle 48. The primary door 14 further includes the secondary door 24. The secondary door 24 is selectively couplable to the primary door frame 44 and has a secondary handle 52. It is contemplated that the primary handle 48 may be operably coupled to the secondary door 24, allowing both the secondary door 24 and the primary door 14 to be operable using the primary handle 48.

The secondary door 24 is selectively slideable from the primary door frame 44 and moves between a first position and a second position. The secondary door 24 may be coupled to the track assembly 30 and/or the rack 56, allowing the track assembly 30 and/or the rack 56 to slide between a first position and a second position with the secondary door 24. The track assembly 30 and the rack 56 are in the first position when the secondary door 24 is in the first position and in the second position when the secondary door 24 is in the second position.

In FIGS. 1A-1C, the secondary door 24 is positioned between a first end 60 of the primary door 14 and a second end 64 of the primary door 14. However, it is contemplated that the secondary door 24 may be positioned at the first end 60 of the primary door 14, may be positioned at the second end 64 of the primary door 14, or may be positioned any distance between the first end 60 and the second end 64. Further, although the appliance 16 shown in FIGS. 1A-1C is a combination range having a single oven and warming drawer below, the general configuration is not meant to be limiting and other styles and configurations are contemplated. For example, the appliance 16 could be a wall oven, a double oven, a single oven without a warming drawer, a single oven with a warming drawer above, a freestanding range, a combination oven, etc. Where the appliance configuration varies, the secondary door 24 may include other features to adapt to the appliance, such as, for example, a split for a double door oven.

As shown in FIGS. 1A and 1B, the primary door 14 may be in a closed position where the primary door 14 seals the cavity 20. When the primary door 14 is in the closed position, the secondary door 24 may be engaged with the primary door frame 44 to prevent inadvertent opening of the secondary door 24. Further, when the secondary door 24 is engaged with the primary door frame 44, the secondary door 24 may be pivotally rotated with the primary door 14 as the primary door 14 moves between the closed position (FIG. 1A) and an open position (FIG. 1B).

As shown in FIG. 1C, the secondary door 24 may be disengaged from the primary door frame 44 so that the secondary door 24 is slidable between the first position (FIG. 1A) and the second position (FIG. 1C). When the secondary door 24 is disengaged from the primary door frame 44, the secondary door 24 and the primary door 14 may still be in the closed position and the first position, respectively. The secondary door 24 is slidable between the first position (FIG. 1A) and the second position (FIG. 1C) to allow a user access to the rack 56 that is received and guided by a channel 58. The channel 58 is configured to house the rack 56 when the rack 56 is positioned within the cavity 20. The movement of the secondary door 24 is accomplished without moving the primary door 14 into the open position. When the secondary door 24 is disengaged from the primary door frame 44, the secondary door 24 may be operably coupled to the track assembly 30 positioned within the cavity 20 of the appliance 16. The track assembly 30 may slide to the first position. The rack 56 may also slide along the channel 58 to the first position exterior of the appliance. When the rack 56 is in the first position, the user has access to the rack 56 while the primary door 14 is in the closed position. The rack may then slide back into the cavity 20 to a second position, wherein the rack 56 is fully received by the channel 58. It is contemplated that the rack 56 may be replaced by any sliding surface, including a tray, stone, cart, etc. that may be useful for use within an appliance.

Figure 2A:
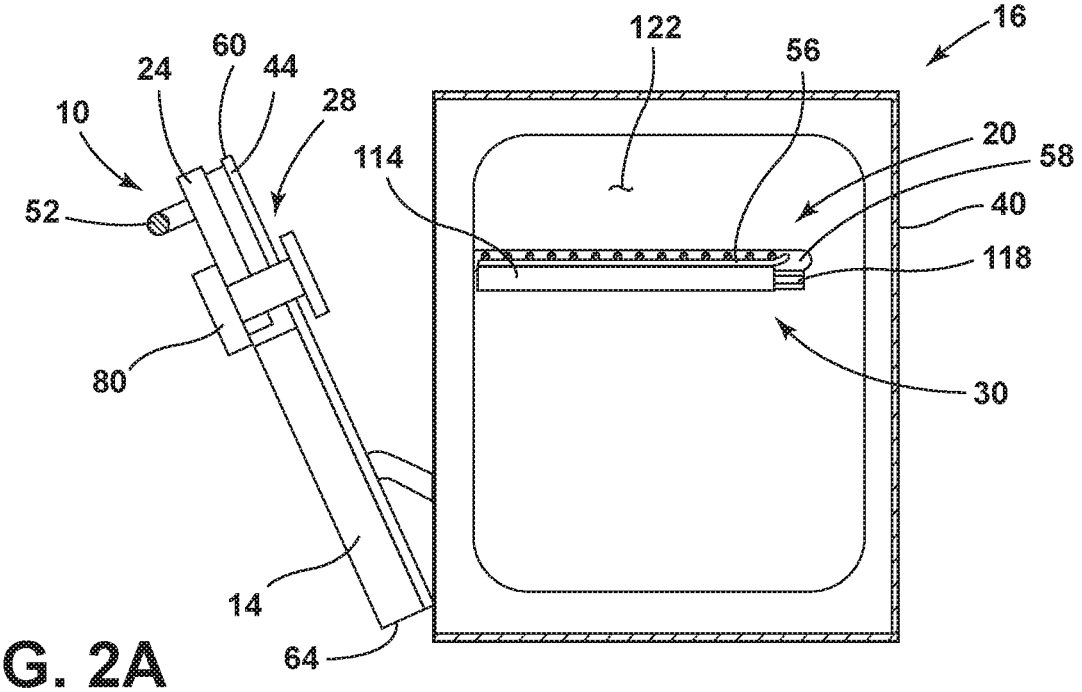
FIG. 2A is a cross-sectional view of the appliance of FIG. 1B taken along line B-B with the primary door in the open position and a secondary door having an engagement feature according to some examples.
Figure 2B:
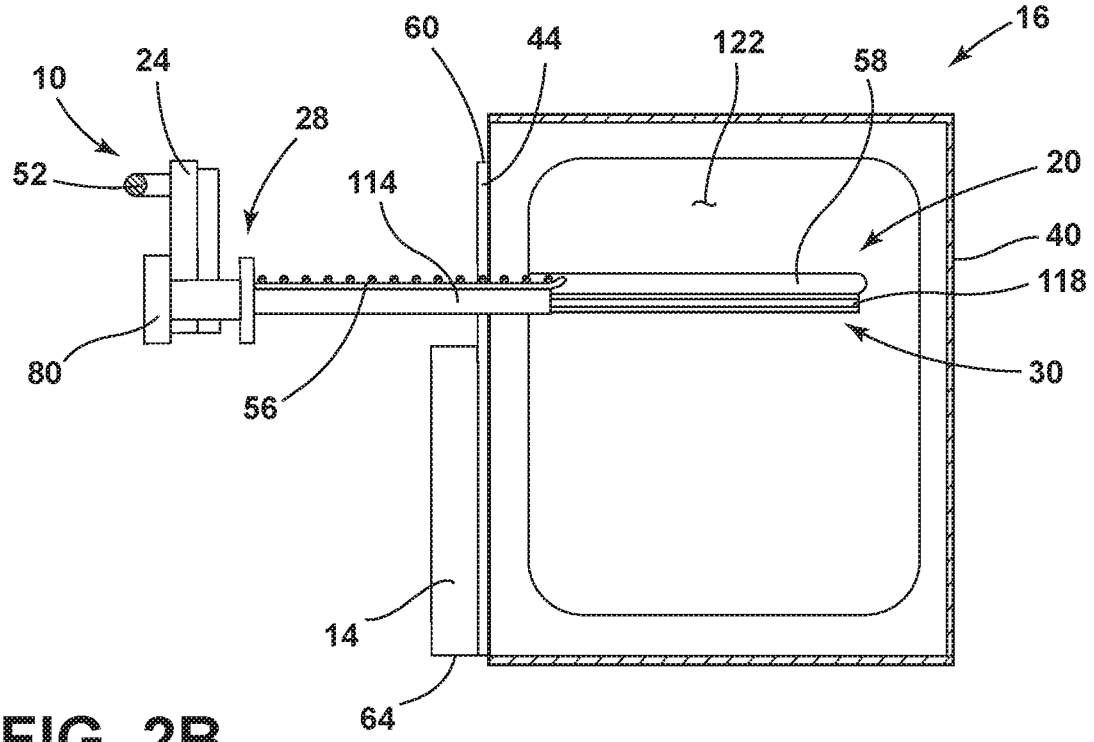
FIG. 2B is a cross-sectional view of the appliance of FIG. 1C taken along line C-C with a primary door in a closed position and the secondary door in the open position according to some examples.
Figure 9:
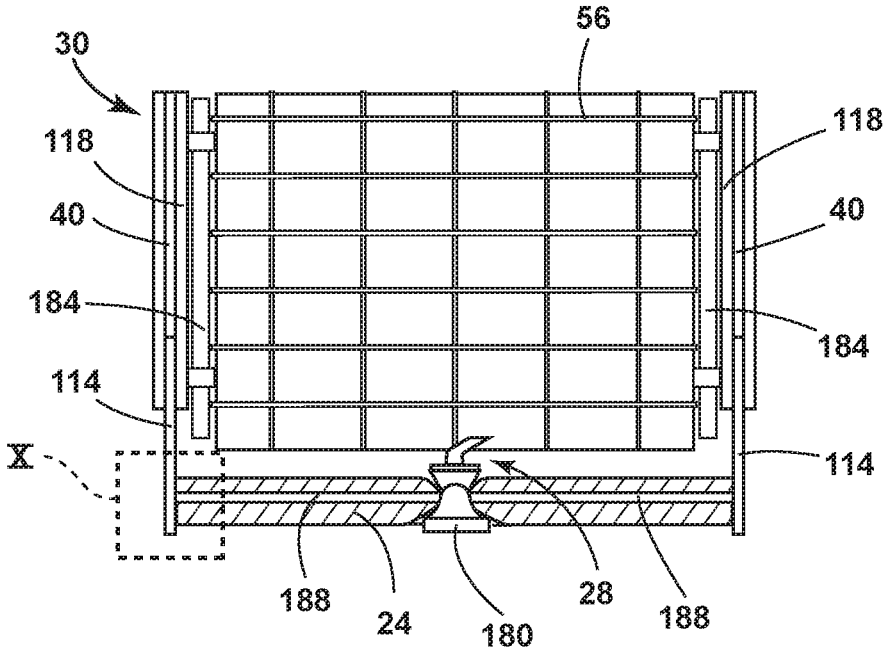
FIG. 9 is a top view of a rack and pin assembly according to some examples.

Referring now to FIGS. 2A and 2B, the appliance 16 is shown having the primary door 14 and the primary door frame 44 in the closed position. The secondary door 24 is disposed at the first end 60 of the primary door 14 and includes an actuator 80. It will be understood that the actuator 80 may be a knob, switch, button, etc. and may be actuatable manually, remotely, automatically, electronically, or any combination of the like without departing from the scope of the present disclosure. The actuator 80 is operably coupled to the first engagement feature 28 configured to engage with the rack 56. The first engagement feature 28 is operable between the first position (FIG. 2A) and the second position (FIG. 2B). In the first position, the first engagement feature 28 may operably couple the secondary door 24 with the primary door frame 44, allowing the secondary door 24 to move pivotally with the primary door 14 (FIG. 2A). In the second position, the first engagement feature 28 is received by the rack 56 and secures the rack 56 to the secondary door 24. This allows the rack 56 to slide along the channel 58 as the secondary door 24 moves between the first position and the second position, as further shown in FIGS. 3A and 3B. The first engagement feature 28 may further engage with support slides 114 of the track assembly 30. Alternatively, multiple engagement features may be used to engage with various portions of the rack 56 and/or the support slides 114 as shown in FIG. 9.

Figure 3A:
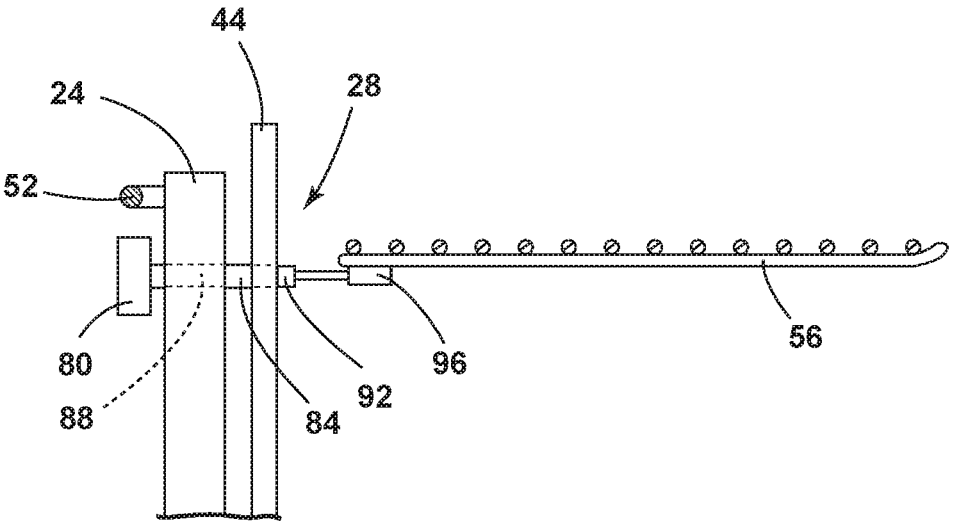
FIG. 3A is a cross-sectional view of the appliance of FIG. 1A taken along line A-A with the engagement feature in a first position according to some examples.
Figure 3B:
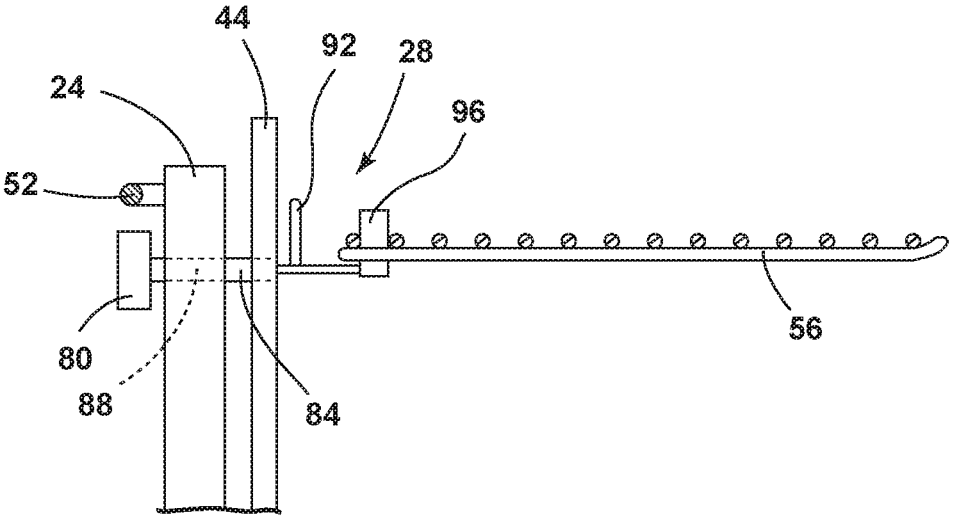
FIG. 3B is a cross-sectional view of the appliance of FIG. 1A taken along line A-A with the engagement feature in a second position according to some examples.

Referring now to FIGS. 3A and 3B, the actuator 80 is operably coupled to the first engagement feature 28. The first engagement feature 28 includes a shaft 84 that extends from the actuator 80 and through an aperture 88 defined by the secondary door 24. The shaft 84 is operably coupled to a first flange 92 configured to engage with the primary door frame 44 and a second flange 96 configured to engage with the rack 56. The first flange 92 is operably coupled to the second flange 96 by the shaft 84 so that, together with the actuator 80, the first flange 92 and the second flange 96 rotate as one piece between a first position and a second position. When the first flange 92 and the second flange 96 are in the first position, the first engagement feature 28 as a whole is in the corresponding first position. When the first flange 92 and the second flange 96 are in the second position, the first engagement feature 28 is in the corresponding second position.

In the first position, as shown in FIG. 3A, the first flange 92 is engaged with the primary door frame 44, preventing any movement of the secondary door 24 relative to the primary door frame 44. The second flange 96 is also disengaged from the rack 56. This allows the secondary door 24 to move with the primary door 14 between the open position and the closed position. In the second position, as shown in FIG. 3B, the first flange 92 is disengaged from the primary door frame 44, providing the secondary door 24 with the ability to slide between the first position and the second position. The second flange 96 is engaged with the rack 56, operably coupling the rack 56 with the secondary door 24. The secondary door 24 is further coupled to the support slides 114. The support slides 114 support the secondary door 24 as the secondary door 24 slides between the first position and the second position. The rack 56 slides along the channel 58 as it moves concurrently with the secondary door 24 and the support slides 114 of the track assembly 30. The rack 56 and the support slides 114 are slideable with the secondary door 24 between the first position and the second position. It is contemplated that the first flange 92 and the second flange 96 may be combined so that the first engagement feature 28 includes only one flange configured to selectively engage with one of the primary door frame 44 and the rack 56 without departing from the scope of the present disclosure.

As discussed elsewhere herein, the track assembly 30 is disposed within the cavity 20 and supports the secondary door 24 as it moves between the first position and the second position. The track assembly 30 includes the support slides 114 and a receiving track 118 for guiding the support slides 114. Each receiving track 118 is disposed within the cavity 20 and is operably coupled to an inner surface 122 of the appliance 16. The support slides 114 are received within the receiving track 118 and slides fore and aft of the cavity 20. The rack 56 may be coupled to the support slides 114, or, alternatively, the rack 56 may be selectively couplable to the secondary door 24 only, with the support slides 114 positioned only to support the secondary door 24. Operably coupling the rack 56 to the secondary door 24 allows the user to access the rack 56 from the exterior of the appliance 16 without opening the primary door 14 and risking burns or heat loss from the cavity 20. When the user no longer needs to access the rack 56, the secondary door 24 may slide into the first position, sliding the rack 56 back into the channel 58 and sliding the support slides 114 back into full engagement with the receiving track 118.

Figure 4A:
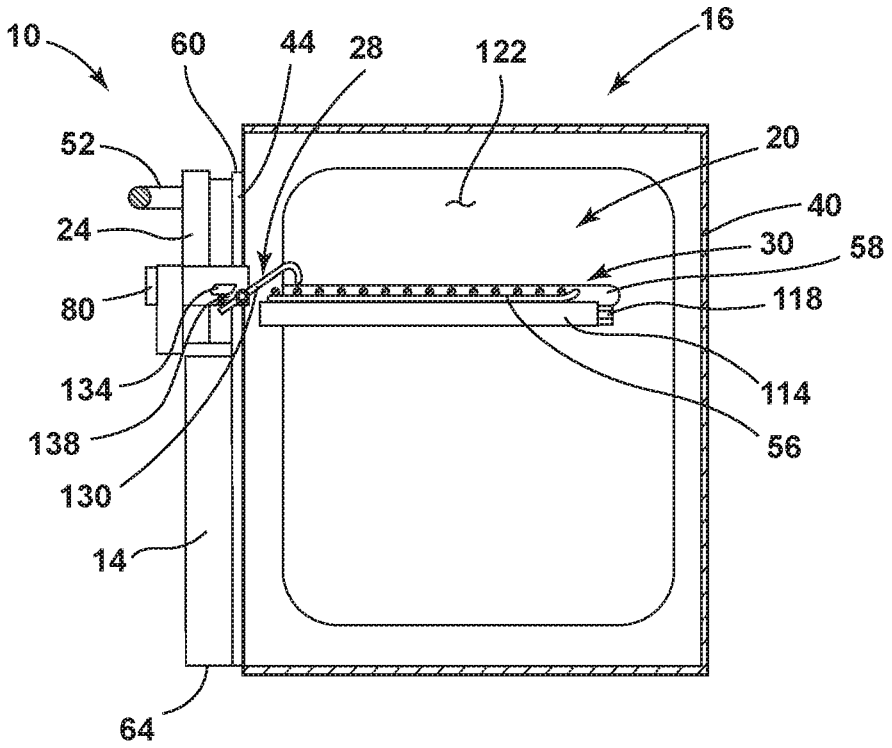
FIG. 4A is a cross-sectional view of the appliance of FIG. 1A taken along line A-A with a hook element disengaged from a rack according to some examples.
Figure 4B:
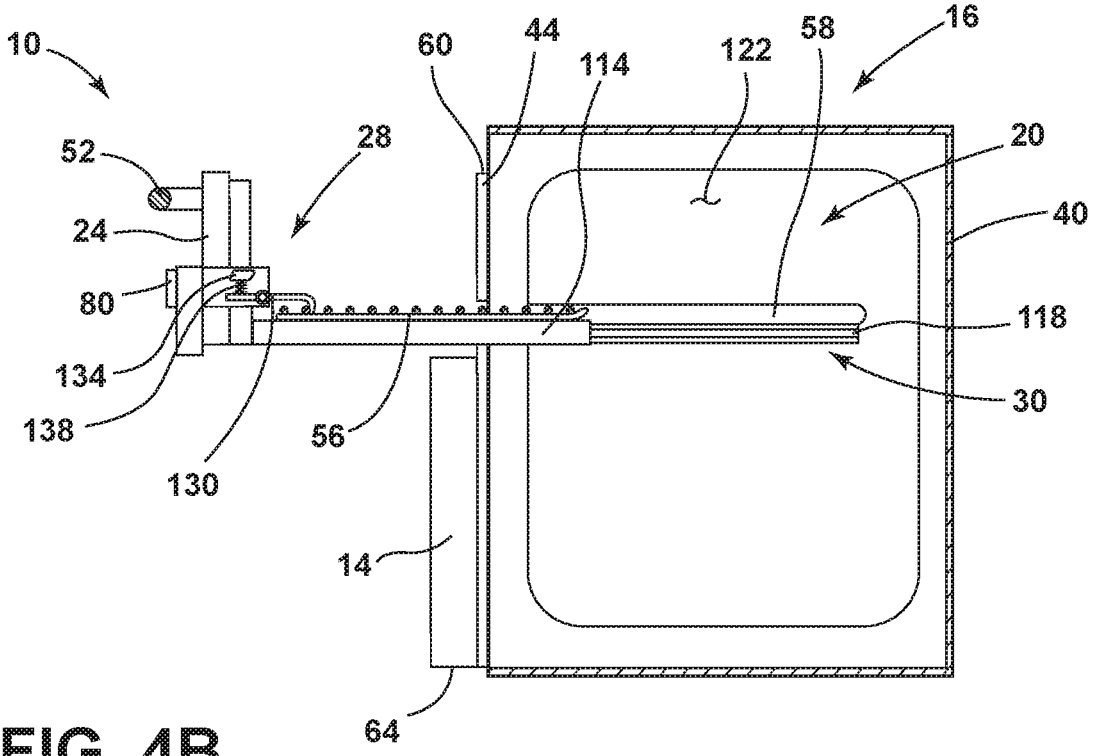
FIG. 4B is a cross-sectional view of the appliance of FIG. 1C taken along line C-C with a hook element engaged with a rack according to some examples.

Referring now to FIGS. 4A and 4B, the appliance 16 is shown having the actuator 80 disposed on the secondary door 24. As previously discussed herein, the actuator 80 is operable between the first position and the second position. The actuator 80 is operably coupled to the first engagement feature 28, which may be spring-biased. The actuator 80 may include a hook 130, a plate 134 and a spring 138. When the actuator 80 is in the first position, the first engagement feature 28 is in the first position and the spring 138 is compressed by the plate 134, raising the hook 130 so that the hook 130 is disengaged from the rack 56. When the actuator 80 is in the second position, the spring 138 is released, biasing the hook 130 into the second position. When the hook 130 is in the second position, the hook 130 is operably coupled with the rack 56 so that the rack 56 moves in conjunction with the secondary door 24. When the secondary door 24 moves into the second position with the support slides 114, the rack 56 is pulled outwardly of the cavity 20, as discussed elsewhere herein. When the secondary door 24 moves from the second position to the first position, the hook 130 pushes the rack 56 back into the cavity 20, and the support slides 114 are stacked with the receiving track 118, as discussed elsewhere herein.

Figure 5:
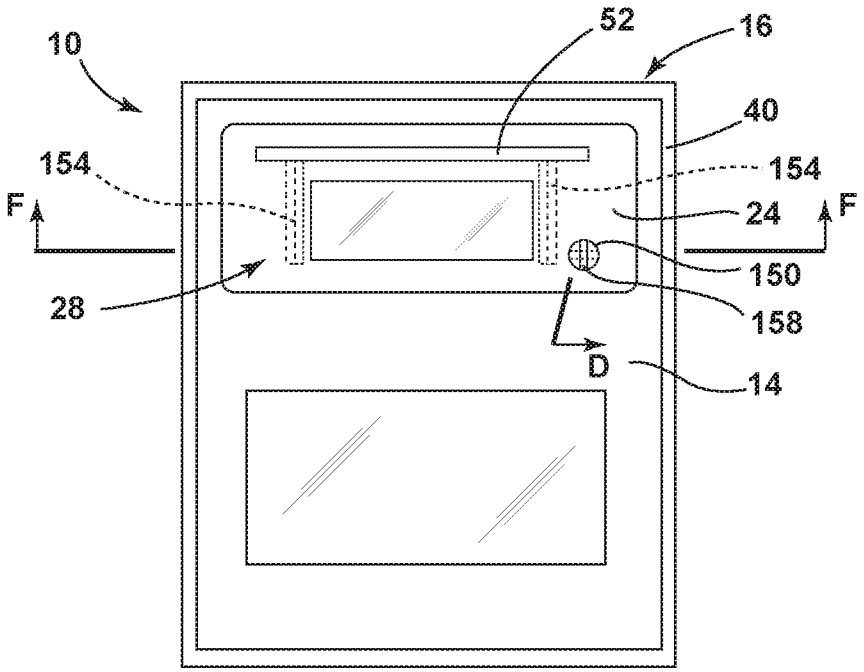
FIG. 5 is a front profile view of an appliance having a primary door and a secondary door with magnetic plates.

Referring now to FIG. 5, the appliance 16 is shown with the secondary door 24 disposed at the first end 60 of the primary door 14. The secondary door 24 includes an actuator 150, or switch, moveable between a first position and a second position. The actuator 150 may be disposed on the front surface of the secondary door 24, the front surface of the primary door 14, on the primary handle 48 of the primary door 14, on the secondary handle 52 of the secondary door 24, or on any other surface proximate the secondary door 24. The actuator 150 may be manual or electric, and the actuator 150 may be controlled directly or indirectly by the user. The actuator 150 controls permanent magnetic plates 154 configured to selectively engage with the rack 56, alternating the magnetic plates 154 between an attracting position and a neutral position. It is contemplated that the actuator 150 may include an opposing magnetic plate 158 configured to rotate with the actuator 150.

Figure 5A:
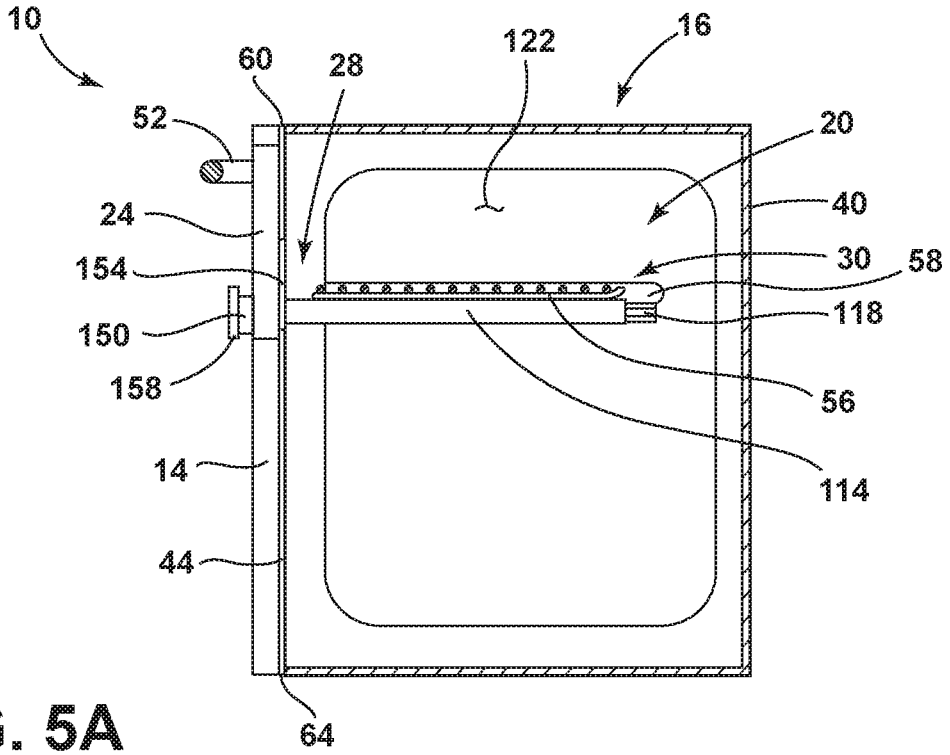
FIG. 5A is a cross-sectional view of the appliance of FIG. 5 taken along line D-D with the magnetic plates disengaged from a rack according to some examples.
Figure 5B:
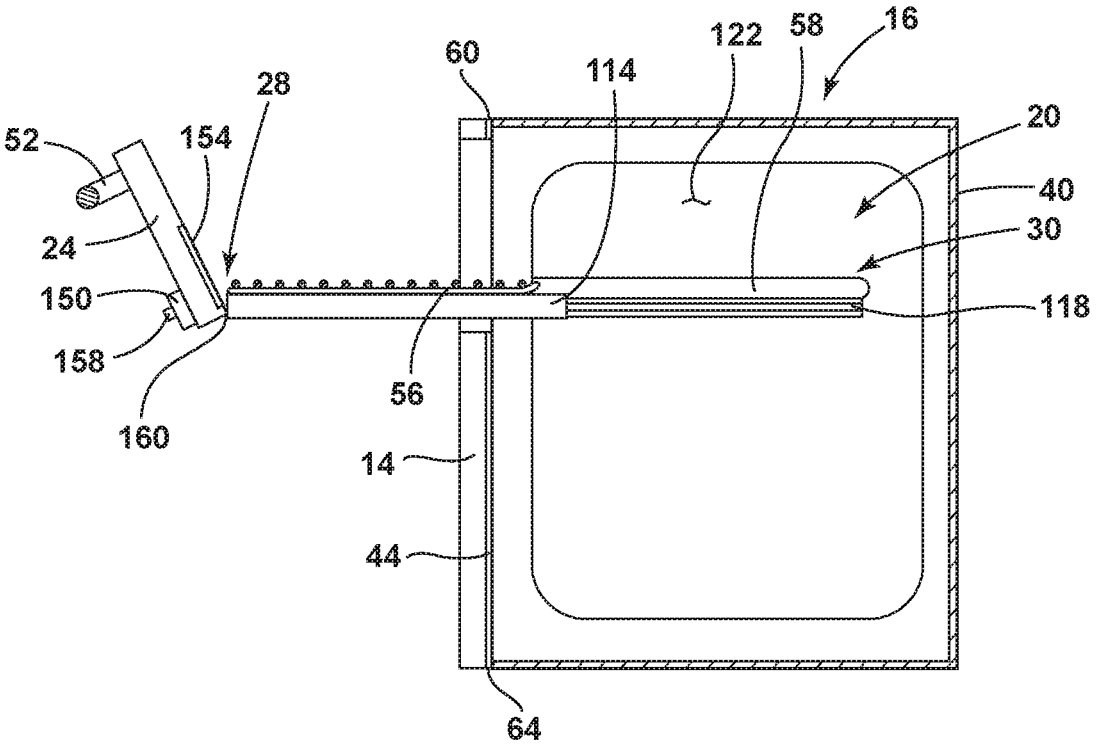
FIG. 5B is a cross-sectional view of the appliance of FIG. 5 taken along line D-D with the magnetic plates engaged with a rack and the secondary door in an open position according to some examples.

Referring now to FIGS. 5A and 5B, the magnetic plates 154 may be fine-pole permanent magnetic plates. The fine-poles are approximately ⅛ to ⅜ inches in diameter. The referenced dimensions allow the magnetic plates 154 to magnetically engage with the rack 56 when the actuator 150 is in the second position. The magnetic plates 154 are permanent magnets and so remain in the attracting state, engaging with the rack 56 unless acted upon by an opposing magnetic field. The permanent magnetic plates 154 operably coupled the rack 56 with the secondary door 24. Operably coupling the rack 56 to the secondary door 24 allows the rack 56 to move with the secondary door 24 between the first position and the second position, as described elsewhere herein.

When the actuator 150 is moved to the first position, the magnetic plates 154 are exposed to an opposing magnetic field. The opposing magnetic field is opposing relative to the magnetic plates 154. The opposing magnetic field may be produced by the opposing magnetic plate 158. However, it is contemplated that the opposing magnetic field may be created with another permanent magnetic plate or any other magnetic force applied opposite the fine-pole permanent magnetic plates 154. The opposing magnetic field redirects the magnetic field produced by the magnetic plates 154, reducing or eliminating altogether the draw of the rack 56 to the magnetic plates 154. The opposing magnetic field places the magnetic plates 154 in a neutral state, disengaging the magnetic plates 154 from attracting any object. This allows the primary door 14 and the secondary door 24 to move without being engaged with the rack 56.

The strength of the magnetic force exerted by the fine-pole permanent magnetic plates 154 may vary across embodiments and may be determined based on the configuration of the rack 56, the appliance 16, and/or other features of the first engagement feature 28. Additionally, it will be understood that the illustrated configuration of the permanent magnetic plates 154 is exemplary only and that the permanent magnetic plates 154 may be positioned on any part of the secondary door 24 to provide an attractant force to the rack 56.

As shown in FIG. 5B, the secondary door 24 may include a secondary door hinge 160 positioned between the support slides 114 and the secondary door 24. The secondary door hinge 160 allows the secondary door 24 to pivot while also sliding between an open and closed position, providing the user greater access to the rack 56. The secondary door hinge 160 may be operable when the secondary door 24 is in the open position and when the secondary door 24 is in the closed position. It is contemplated that the secondary door 24 may include the secondary door hinge 160 in any embodiment disclosed herein without departing from the scope of the present disclosure.

Figure 6A:
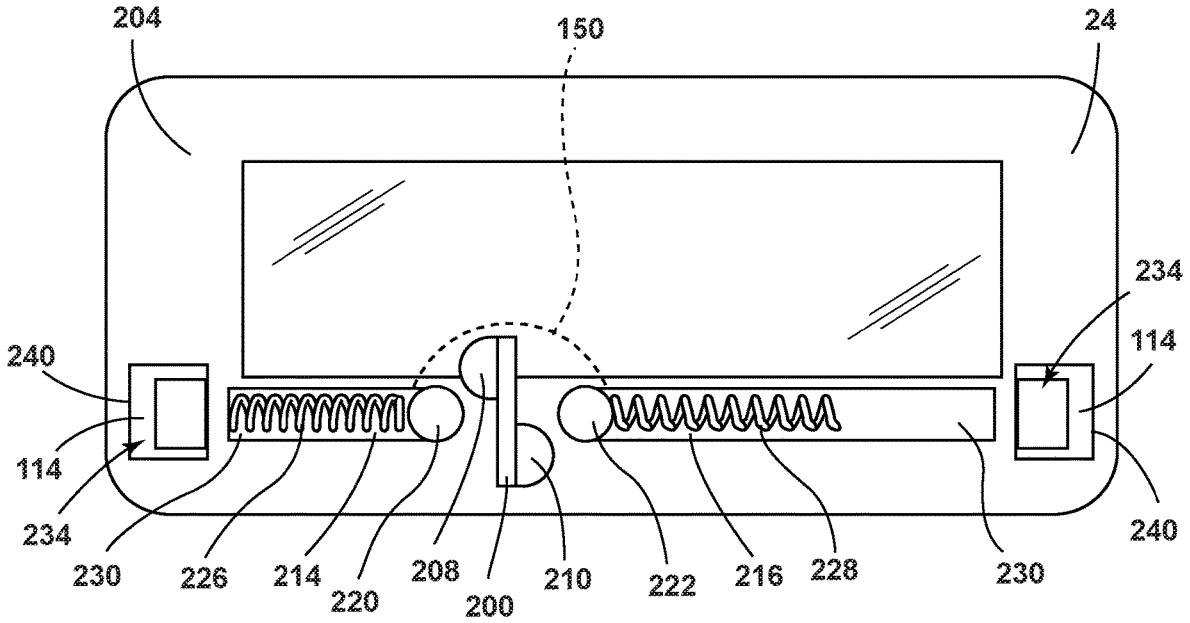
FIG. 6A is a cross-sectional view of the secondary door of FIG. 5 taken along line F-F with an engagement feature in a first position.
Figure 6B:
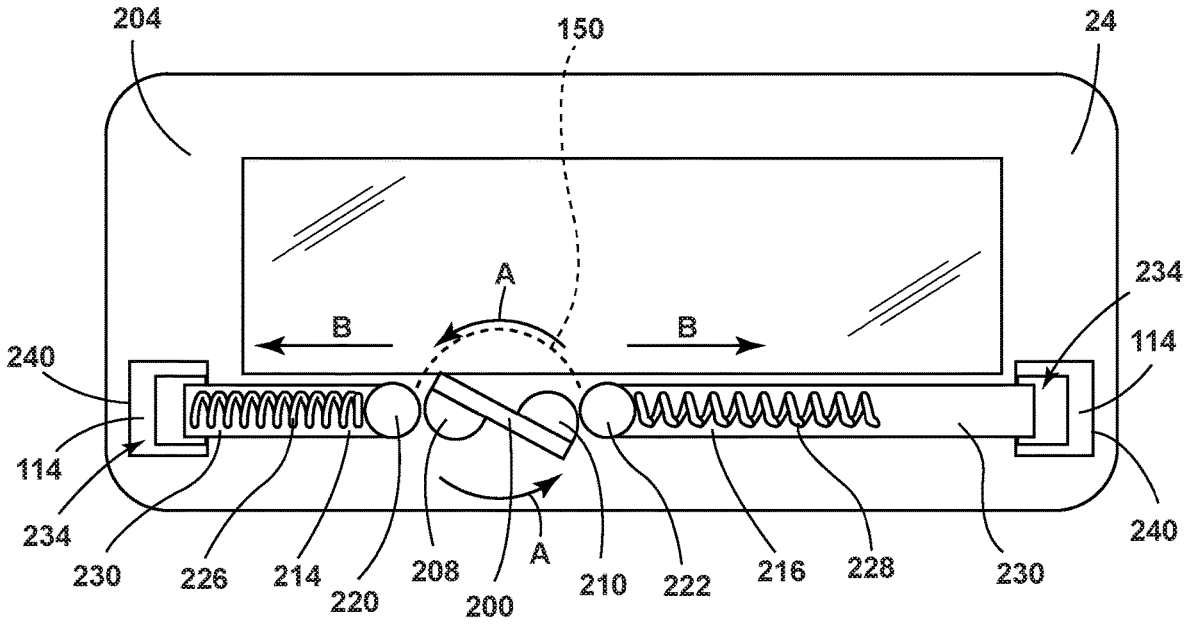
FIG. 6B is a cross-sectional view of the secondary door of FIG. 5 taken along line F-F with an engagement feature in a second position.

Referring now to FIGS. 6A and 6B, in some examples, the actuator 150 may include the second engagement feature in the form of a rotatable engagement feature 200 and/or first and second engagement prongs 214, 216. The rotatable engagement feature 200 is positioned substantially flush with an interior surface 204 of the secondary door 24. The engagement feature 200 may include first and second engagement protrusions 208, 210 positioned on opposing ends of the engagement feature 200. The first and second engagement protrusions 208, 210 may be generally semi-spherical in shape in some examples. In other examples, the first and second engagement protrusions 208, 210 may be prisms with one of various cross-sections including, for example, a square, a rectangle, a triangle, or any other shape.

The engagement feature 200 and the first and second engagement protrusions 208, 210 are positioned between a first and second engagement prongs 214, 216. Each engagement prong 214, 216 is operably coupled to the secondary door 24 and includes a rounded first end 220, 222 positioned proximate the engagement feature 200 and first and second springs 226, 228 positioned within each engagement prong 214, 216 to bias the engagement prongs 214, 216 in a first position, in some examples. In other examples, the first and second springs 226, 228 may be positioned on the exterior of the first and second engagement prongs 214, 216. The engagement feature 200 and the first and second engagement prongs 214, 216 may be positioned on the interior surface 204 of the secondary door 24, in some examples. In other examples, the engagement feature 200 and the first and second engagement prongs 214, 216 may be positioned within the secondary door 24.

The first and second engagement prongs 214, 216 are spaced a first distance apart and the first and second engagement protrusions 208, 210 are spaced a second distance apart. The first distance is less than the second distance. When the actuator 150 is in the first position (FIG. 5A), the engagement feature 200 is vertically positioned between the first and second engagement prongs 214, 216 and the first and second engagement prongs 214, 216 are in the corresponding first position. When the actuator 150 is rotated into the second position (FIG. 5B), the engagement feature 200 rotates to be horizontally positioned between the first and second engagement prongs 214, 216 as the engagement protrusions 208, 210 rotate along a predetermined path, as shown by arrows A. Because the second distance between the first and second engagement protrusion 208, 210 is less than the first distance between the first and second engagement prongs 214, 216, the engagement prongs 214, 216 are pushed laterally outward along predetermined paths, as shown by arrows B.

When the engagement prongs 214, 216 are pushed laterally outward, a second end 230 of each of the first and second engagement prongs 214, 216 extends laterally. The second ends 230 are received in respective receiving wells 234 defined by the support slides 114. Each of the receiving wells 234 is positioned to engage with a second end 230 and operably couple the secondary door 24 to the support slides 114. This allows the support slides 114 to move in conjunction with the secondary door 24, as discussed elsewhere herein. It will be understood that the use of the engagement feature 200 and the engagement prongs 214, 216 engaged with the support slides 114 may be used with any of the other examples illustrated herein without departing from the scope of the present disclosure.

Figure 7B:
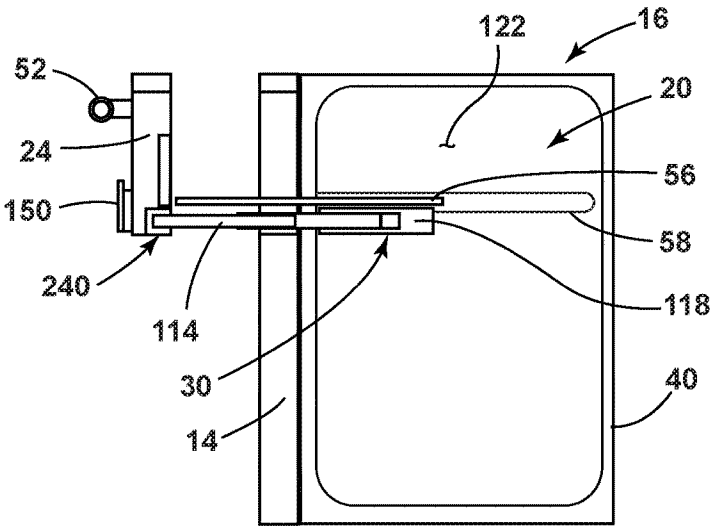
FIG. 7B is a cross-sectional view of the appliance of FIG. 1C taken along line C-C according to some examples.
Figure 7A:
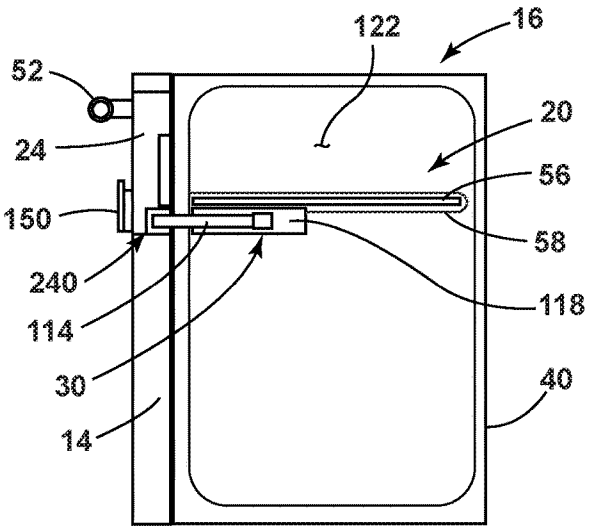
FIG. 7A is a cross-sectional view of the appliance of FIG. 1A taken along line A-A according to some examples.
Figure 7C:
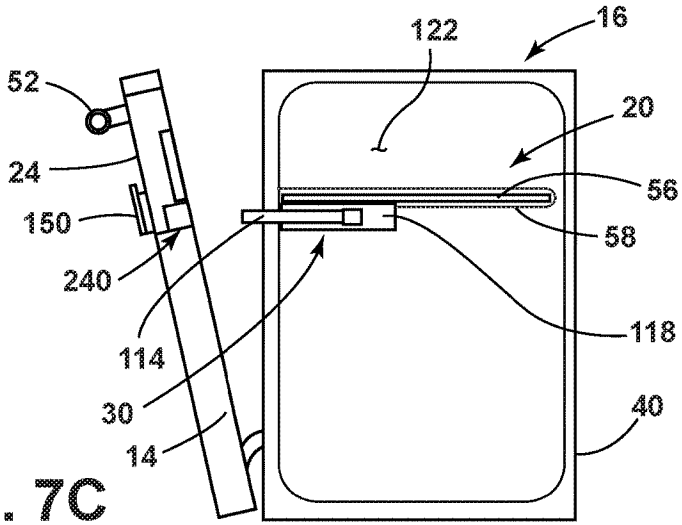
FIG. 7C is a cross-sectional view of the appliance of FIG. 1B taken along line B-B according to some examples.

Referring now to FIGS. 7A-7C, the support slides 114 extend a predetermined distance outward of the cavity 20 of the appliance 16. The support slides 114 are positioned to be received by receiving spaces 240 positioned on the secondary door 24 and having a depth equal to the predetermine distance the support slides 114 extend. When the primary door 14 is in the closed position and the secondary door 24 is in the first position, the support slides 114 are received into the receiving space 240 (FIG. 7A). When the secondary door 14 is in the first position, the support slides 114 may be engaged with the secondary door 24, as discussed elsewhere herein (see FIGS. 6A and 6B). When the support slides 114 are engaged with the secondary door 24, and the secondary door 24 is moved into the second position, the support slides 114 slide outward of the cavity 20 with the secondary door 24 (FIG. 7B). The rack 56 may be operably coupled to the secondary door 24 using, for example, an engagement hook, an engagement feature, etc. When the support slides 114 are disengaged from the secondary door 24, the secondary door is engaged with the primary door 14 and is movable with the primary door 14 relative to the appliance 16 and cavity 20 (FIG. 7C).

Figure 8:
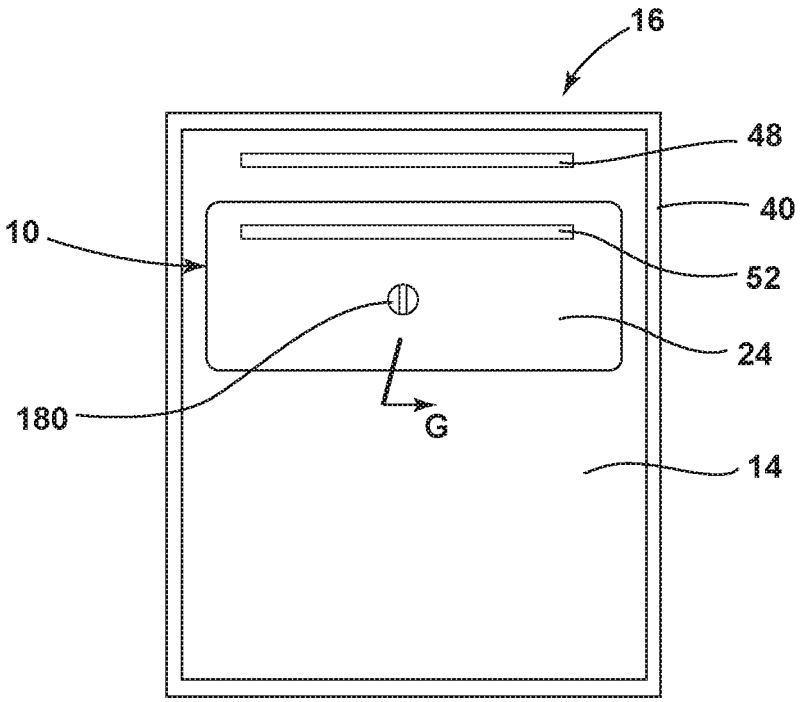
FIG. 8 is a front profile view of an appliance having a primary door and secondary door with an actuator.
Figure 8A:
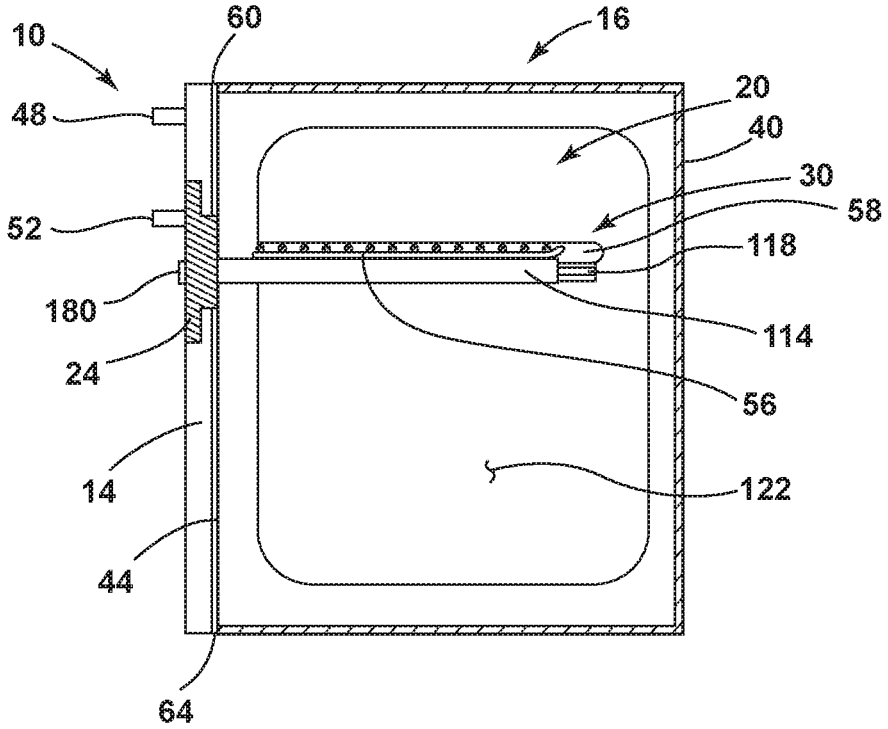
FIG. 8A is a cross-sectional view of the appliance of FIG. 8 taken along line G-G with a pin assembly disengaged from a rack according to some examples.
Figure 8B:
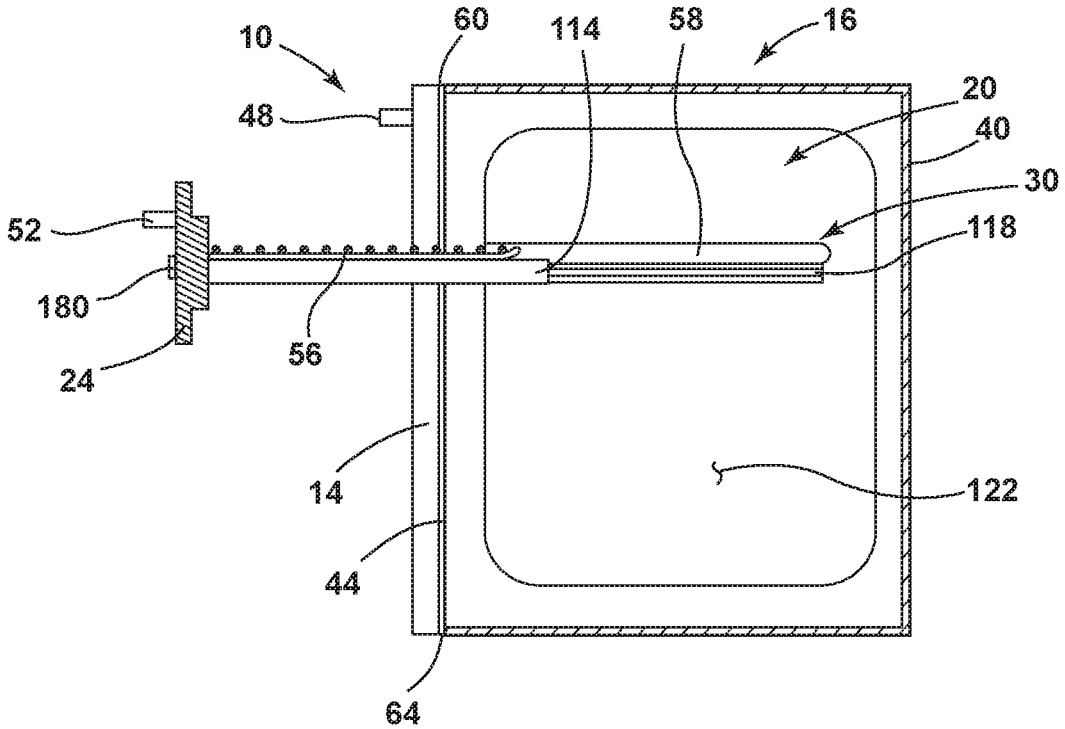
FIG. 8B is a cross-sectional view of the appliance of FIG. 8 taken along line G-G with the pin assembly engaged with the rack according to some examples.

Referring now to FIGS. 8-8B, an actuator 180, or button, is positioned on the primary door 14 or on the secondary door 24. It is contemplated that the actuator 180 may also be positioned on any part of the appliance 16 without departing from the scope of the present disclosure. When the actuator 180 is in a first position, the secondary door 24 is disengaged from the rack 56 and the support slides 114 and engaged with the primary door frame 44, as shown in FIG. 8A. When the actuator 180 is in a second position, the secondary door 24 is engaged with the rack 56, as shown in FIG. 8B. When the secondary door 24 is engaged with the rack 56 and the support slides 114, as shown in FIG. 8B the rack 56 is movable with the secondary door 24 between the first position and the second position and the secondary door 24 is supported by the support slides 114, as previously discussed herein. When the rack 56 and the support slides 114 are disengaged from the secondary door 24, as shown in FIG. 8A, the rack 56 remains within the channel 58 and each of the support slides 114 remains fully engaged with the respective receiving track 118, housing the rack 56 and the track assembly 30 within the cavity 20 while the primary door 14 and the secondary door 24 are free to move separately or together, as previously discussed elsewhere herein.

Figure 10:
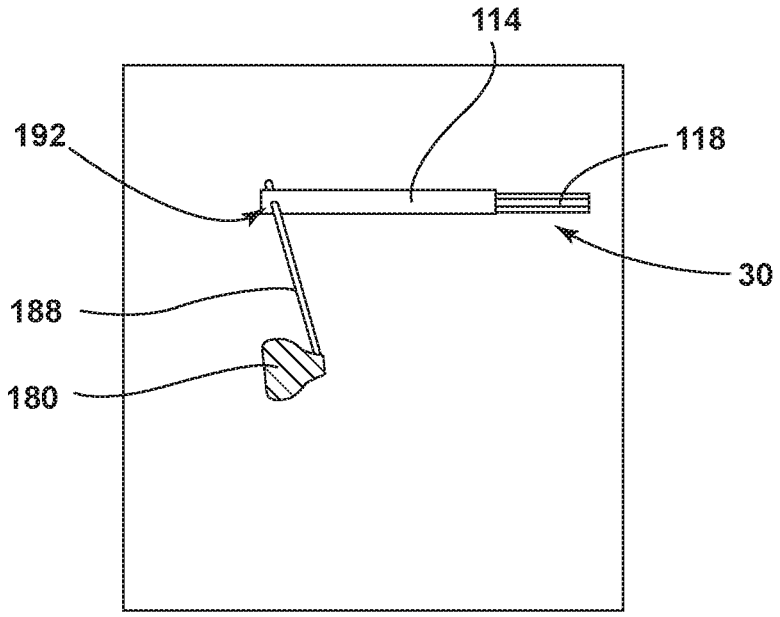
FIG. 10 is a side perspective view of the pin assembly of FIG. 9 engaged with the rack.
Figure 11:
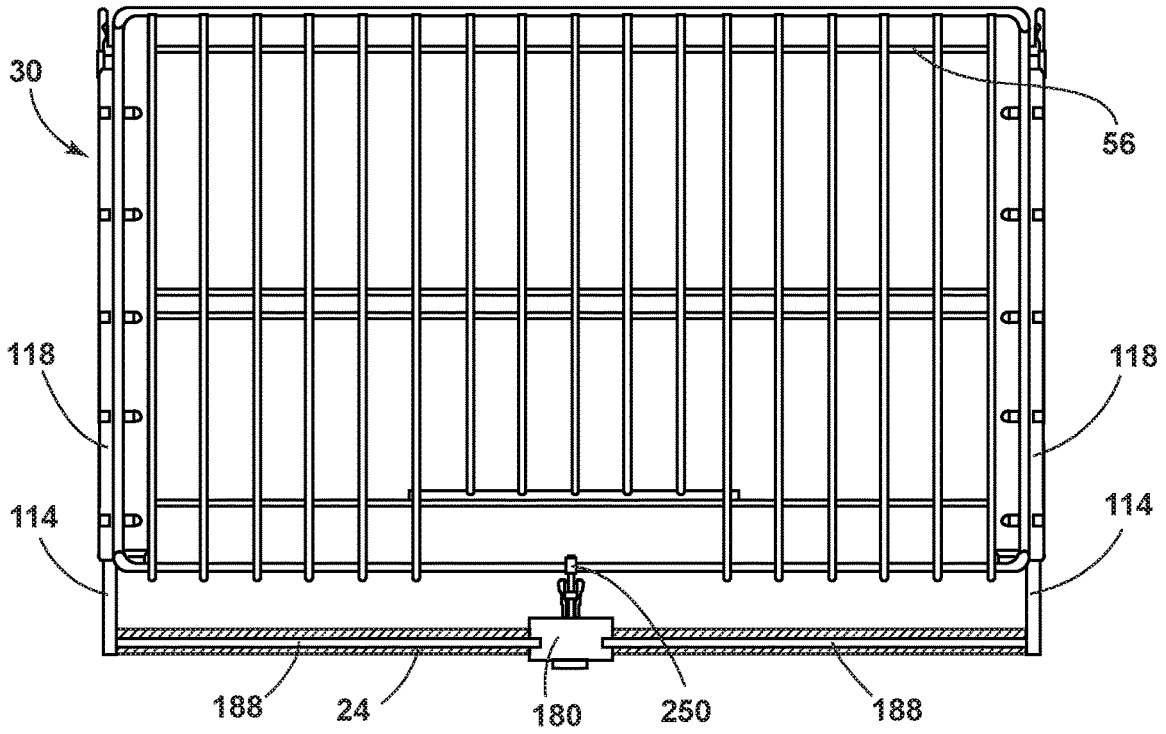
FIG. 11 is a top view of a rack and pin assembly according to some examples.
Figure 12:
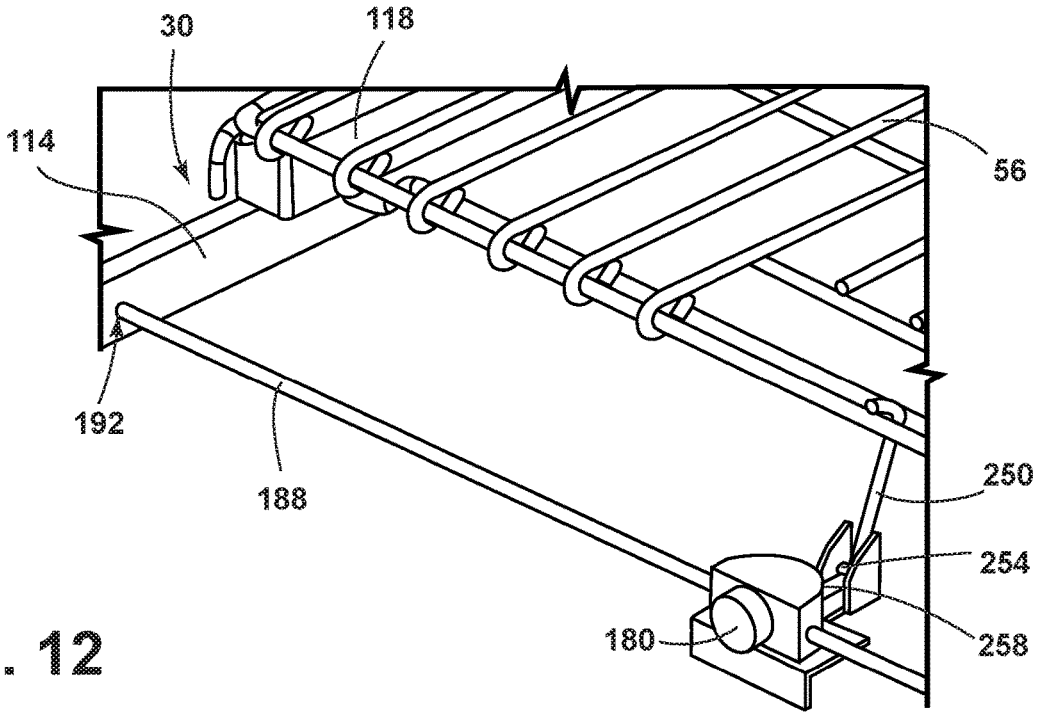
FIG. 12 is a side perspective view of the pin assembly of FIG. 11 engaged with the rack.

Referring now to FIGS. 9-12, in some examples, the actuator 180 is operably coupled with laterally opposing pins 188 extending parallel with the secondary door 24. The laterally opposing pins 188 are operable between an extended position and a retracted position. When the actuator 180 is in the first position, the pins 188 are in the retracted position and are disengaged from the support slides 114. When the actuator 180 is in the second position, the pins 188 are in the extended position and are received by connection apertures 192 defined by the support slides 114. When the pins 188 are each received by the respective connection apertures 192, the secondary door 24 is operably coupled to the support slides 114, allowing the secondary door 24 to move between the first position and the second position. When the support slides 114 are used to support the secondary door 24 as it moves along the track assembly 30, the rack 56 may slide with the secondary door 24. In some examples, as shown in FIGS. 9 and 10, the rack 56 will slide along the channel 58 and with the support slides 114 and the secondary door when the rack 56 is operably coupled to the secondary door 24 by the first engagement feature 28, as shown in FIGS. 2A-6B. It will be understood that the second engagement feature, illustrated in FIGS. 9 and 10 in the form of laterally opposing pins 188, may be paired with any of the exemplary embodiments for the first engagement feature discussed elsewhere herein. In other examples, as shown in FIGS. 11 and 12, the actuator 180 may be operably coupled to an engagement hook 250. The engagement hook 250 may be rotatable about a pivot 254 positioned proximate to the actuator 180. When the actuator 180 is in the first position, the engagement hook 250 is disengaged from the rack 56. When the actuator 180 is in the second position, a cam 258 is pushed toward the engagement hook 250. The cam 258 contacts the engagement hook 250 and exerts pressure on the engagement hook 250, biasing the engagement hook 250 upward into engagement with the rack 56. The cam 258 remains in contact with the engagement hook 250 until the actuator 180 is returned to the first position. This allows the rack 56 to be pulled with the secondary door 24 as the secondary door 24 moves from the first position to the second position.

The use of a secondary door 24 provides benefits to the user, allowing the user to access the rack 56 without heat loss from opening the primary door 14. The secondary door 24 also prevents the user from having to insert the user's hand and/or arm into the cavity 20 to access food or other items on the rack. This prevents inadvertent burns to the user and may also prevent the food or other items from falling into the cavity 20 when being removed from the rack 56. The use of a secondary door 24 may also prevent delays in the preheating time, allowing the user to keep the primary door 14 in the closed position, effectively sealing most of the cavity 20 even when the food or other items are being checked by the user.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An appliance door assembly, comprising:

a primary door pivotally coupled to an appliance and positioned to seal a cavity defined by the appliance;

a track assembly disposed within the cavity, wherein the track assembly includes support slides defining receiving wells;

a secondary door slideably coupled to the primary door, wherein the secondary door is slidable between a first position and a second position when the primary door is in a closed position;

a rotatable engagement feature operable between first and second positions, wherein the rotatable engagement feature is configured to extend laterally opposing engagement prongs to be received by the receiving wells of the track assembly when the rotatable engagement feature is moved from the first position to the second position, and further wherein the secondary door is operably coupled to the track assembly when the rotatable engagement feature is in the second position and the engagement prongs are received by the receiving wells;

a magnetic engagement feature operable between first and second positions, wherein the first and second positions of the magnetic engagement feature correspond with the first and second positions of the rotatable engagement feature, and further wherein the secondary door is operably coupled to a rack disposed within the cavity when the magnetic engagement feature is in the second position.

2. The appliance door assembly of claim 1, wherein the primary door includes a primary door frame, and further wherein the secondary door is released from the track assembly and operably coupled to the primary door frame by the magnetic engagement feature when the magnetic engagement feature is in the first position.

3. The appliance door assembly of claim 1, wherein the rack and the track assembly concurrently slide exterior of the cavity as the secondary door slides between the first position and the second position.

4. The appliance door assembly of claim 1, includes:

an actuator configured to move the rotatable engagement feature and the magnetic engagement features between the first and second positions.

5. The appliance door assembly of claim 1, wherein the magnetic engagement feature includes a magnetic plate magnetically engaged with the rack when the magnetic engagement feature is in the second position.

6. The appliance door assembly of claim 5, wherein a magnetic field is applied to the magnetic plate when the magnetic engagement feature is in the first position, wherein the magnetic field is magnetically opposing relative to the magnetic plate.

7. The appliance door assembly of claim 1, wherein the track assembly further includes a receiving track operably coupled to an inner surface of the appliance and at least one of the support slides is slideably coupled with the receiving track.

8. An appliance door assembly, comprising:

a primary door having a primary door frame pivotally coupled to an appliance, the appliance defining a cavity;

a secondary door positioned within the primary door and selectively couplable to the primary door frame;

a track assembly positioned within the cavity and including support slides, wherein each support slide defines a receiving well;

a rack engagement feature selectively engageable with a rack disposed within the cavity, wherein the engagement feature is a magnetic plate positioned on the secondary door;

a track assembly engagement feature selectively rotatable to engage with the support slides of the track assembly, wherein the track assembly engagement feature includes first and second engagement prongs operable between retracted and extended positions, and further wherein the engagement prongs are received by the receiving wells of the support slides in the extended position; and an actuator positioned on the appliance and configured to operate the magnetic plate between first and second positions, wherein the magnetic plate is placed in a neutral state when the actuator is activated.

9. The appliance door assembly of claim 8, wherein the rack is operably coupled to the track assembly positioned on an inner surface of the appliance.

10. The appliance door assembly of claim 8, wherein the magnetic plate is in the neutral state when a magnetic field is applied, and further wherein the magnetic field is magnetically opposing relative to the magnetic plate.

11. An appliance door assembly, comprising:

a primary door having a primary door frame, wherein the primary door and the primary door frame are pivotally coupled to an appliance;

a secondary door positioned between a first end and a second end of the primary door and selectively couplable to the primary door frame;

laterally opposing engagement prongs operable by a rotatable engagement feature selectively movable between retracted and extended positions and configured to slideably couple the secondary door with a track assembly in the extended position, wherein the track assembly includes support slides defining receiving wells, and further wherein the laterally opposing engagement prongs are received by the receiving wells in the extended position;

a magnetic engagement feature operably coupled to the actuator, wherein the magnetic engagement feature is magnetically engaged with a rack, and further wherein the actuator is configured to move the magnetic engagement feature to a neutral state and selectively disengage the magnetic engagement feature from the rack; and an actuator positioned on the appliance and operably coupled to the engagement protrusion and the magnetic engagement feature.

12. The appliance door assembly of claim 11, wherein the appliance defines a channel configured to house the rack, and further wherein the rack is slideable between a first position and a second position along the channel.

13. The appliance door assembly of claim 1, wherein the engagement protrusions extend from first and second lateral sides of the secondary door.

* * * * *